US008579289B2

(12) United States Patent
Rynda et al.

(10) Patent No.: US 8,579,289 B2
(45) Date of Patent: Nov. 12, 2013

(54) AUTOMATIC SYSTEM AND METHODS FOR ACCURATE CARD HANDLING

(75) Inventors: Robert J. Rynda, Henderson, NV (US); Feraidoon Bourbour, Eden Prairie, MN (US); Ronald R. Swanson, Otsego, MN (US); Attila Grauzer, Las Vegas, NV (US)

(73) Assignee: SHFL entertainment, Inc., Las Vegas, NV (US)

( * ) Notice: Subject to any disclaimer, the term of this patent is extended or adjusted under 35 U.S.C. 154(b) by 328 days.

(21) Appl. No.: 12/943,871

(22) Filed: Nov. 10, 2010

(65) Prior Publication Data

US 2011/0109042 A1 May 12, 2011

Related U.S. Application Data

(63) Continuation-in-part of application No. 11/481,407, filed on Jul. 5, 2006, now Pat. No. 8,342,525, and a continuation-in-part of application No. 11/444,167, filed on May 31, 2006, now Pat. No. 8,353,513.

(51) Int. Cl.
*A63F 1/12* (2006.01)

(52) U.S. Cl.
USPC ..... 273/149 R

(58) Field of Classification Search
None
See application file for complete search history.

(56) References Cited

U.S. PATENT DOCUMENTS

| | | | |
|---|---|---|---|
| 793,489 | A | 6/1905 | Williams |
| 1,014,219 | A | 1/1912 | Hall |
| 1,885,276 | A | 11/1932 | McKay |
| 2,001,220 | A | 5/1935 | Smith |
| 2,001,918 | A | 5/1935 | Nevius |
| 2,016,030 | A | 10/1935 | Woodruff et al. |

(Continued)

FOREIGN PATENT DOCUMENTS

| | | |
|---|---|---|
| WO | 8700764 | 2/1987 |
| WO | WO 98/40136 | 2/1987 |

(Continued)

OTHER PUBLICATIONS

PCT International Search Report and Written Opinion of the International Searching Authority for PCT/US2008/007069, dated Sep. 8, 2008, 10 pages.

(Continued)

*Primary Examiner* — Kurt Fernstrom
*Assistant Examiner* — Dolores Collins
(74) *Attorney, Agent, or Firm* — TraskBritt

(57) ABSTRACT

A playing card handling device comprises a card storing area that supports a stack of playing cards, the card storing area having a playing card support surface. A card removing system is provided that removes playing cards individually from the bottom of the stack. A pivoting arm is automatically moved by a motor between at least two positions, wherein in a first position the end of the arm opposite a pivot is disengaged from a playing card at the top of the stack and in a second position the end of the min is engaged with a playing card at the top of the stack. A processor in the playing card handling device directs movement of the pivoting arm between at least a first and second position when information is known to the processor that a predetermined number of cards is present in the card storing area of the card handling device. Methods of card handling employing the use of a pivotal arm are also disclosed.

30 Claims, 6 Drawing Sheets

(56) References Cited

U.S. PATENT DOCUMENTS 2,043,343 A 6/1936 Warner
2,065,824 A 12/1936 Plass
2,254,484 A 9/1941 Hutchins
2,328,153 A 8/1943 Laing
2,328,879 A 9/1943 Isaacson
2,364,413 A 12/1944 Wittel
2,778,644 A 1/1957 Stephenson
2,937,739 A 5/1960 Levy
2,950,005 A 8/1960 MacDonald
3,147,978 A 9/1964 Sjöstrand
3,235,741 A 2/1966 Plaisance
3,312,473 A 4/1967 Friedman et al.
3,530,968 A * 9/1970 Palmer ..... 194/210
3,595,388 A 7/1971 Castaldi
3,690,670 A 9/1972 Cassady et al.
3,716,238 A 2/1973 Porter
3,897,954 A 8/1975 Erickson et al.
3,944,230 A 3/1976 Fineman
4,159,581 A 7/1979 Lichtenberg
4,232,861 A 11/1980 Maul
4,310,160 A 1/1982 Willette
4,361,393 A 11/1982 Noto
4,368,972 A 1/1983 Naramore
4,385,827 A 5/1983 Naramore
4,388,994 A 6/1983 Suda et al.
4,397,469 A 8/1983 Carter, III
4,494,197 A 1/1985 Troy et al.
4,497,488 A 2/1985 Plevyak et al.
4,512,580 A 4/1985 Matviak
4,513,969 A 4/1985 Samsel, Jr.
4,515,367 A 5/1985 Howard
4,534,562 A 8/1985 Cuff et al.
4,566,782 A 1/1986 Britt et al.
4,586,712 A 5/1986 Lorber et al.
4,659,082 A * 4/1987 Greenberg ..... 273/149 R
4,662,637 A 5/1987 Pfeiffer
4,667,959 A 5/1987 Pfeiffer et al.
4,741,524 A 5/1988 Bromage
4,750,743 A 6/1988 Nicoletti
4,755,941 A 7/1988 Bacchi
4,759,448 A 7/1988 Kawabata
4,770,421 A 9/1988 Hoffman
4,807,884 A 2/1989 Breeding
4,822,050 A 4/1989 Normand et al.
4,832,342 A 5/1989 Plevyak et al.
4,876,000 A 10/1989 Mikhail
4,900,009 A 2/1990 Kitahara et al.
4,926,327 A 5/1990 Sidley
4,951,950 A 8/1990 Normand et al.
4,969,648 A 11/1990 Hollinger et al.
4,995,615 A 2/1991 Cheng
5,000,453 A 3/1991 Stevens et al.
5,067,713 A 11/1991 Soules et al.
5,081,487 A 1/1992 Hoyer et al.
5,121,192 A 6/1992 Kazui
5,121,921 A 6/1992 Friedman et al.
5,179,517 A 1/1993 Sarbin et al.
5,199,710 A 4/1993 Lamle
5,209,476 A 5/1993 Eiba
5,224,712 A 7/1993 Laughlin et al.
5,240,140 A 8/1993 Huen
5,257,179 A 10/1993 DeMar
5,261,667 A 11/1993 Breeding
5,275,411 A 1/1994 Breeding
5,276,312 A 1/1994 McCarthy
5,283,422 A 2/1994 Storch et al.
5,288,081 A 2/1994 Breeding
5,299,089 A * 3/1994 Lwee ..... 361/679.33
5,303,921 A 4/1994 Breeding
5,356,145 A 10/1994 Verschoor
5,362,053 A 11/1994 Miller
5,374,061 A 12/1994 Albrecht
5,382,024 A 1/1995 Blaha
5,382,025 A 1/1995 Sklansky et al.
5,390,910 A 2/1995 Mandel et al.
5,431,399 A * 7/1995 Kelley ..... 273/149 P
5,437,462 A 8/1995 Breeding
5,445,377 A 8/1995 Steinbach
5,470,079 A 11/1995 LeStrange et al.
5,524,888 A 6/1996 Heidel
5,584,483 A 12/1996 Sines et al.
5,586,766 A 12/1996 Forte et al.
5,586,936 A 12/1996 Bennett et al.
5,605,334 A 2/1997 McCrea, Jr.
5,613,912 A 3/1997 Slater
5,651,548 A 7/1997 French et al.
5,655,961 A 8/1997 Acres
5,669,816 A 9/1997 Garczynski et al.
5,676,372 A 10/1997 Sines et al.
5,681,039 A 10/1997 Miller
5,683,085 A 11/1997 Johnson et al.
5,690,324 A 11/1997 Otomo et al.
5,692,748 A * 12/1997 Frisco et al. ..... 273/149 R
5,695,189 A 12/1997 Breeding et al.
5,707,287 A 1/1998 McCrea, Jr.
5,718,427 A 2/1998 Cranford et al.
5,722,893 A * 3/1998 Hill et al. ..... 463/47
5,735,525 A 4/1998 McCrea, Jr.
5,735,742 A 4/1998 French
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,836,775 A * 11/1998 Hiyama et al. ..... 439/159
5,911,626 A 6/1999 McCrea, Jr.
5,919,090 A 7/1999 Mothwurf
5,936,222 A * 8/1999 Korsunsky et al. ..... 235/441
5,941,769 A 8/1999 Order
5,944,310 A 8/1999 Johnson et al.
D414,527 S 9/1999 Tedham
5,985,305 A 11/1999 Peery et al.
5,989,122 A 11/1999 Roblejo
6,015,311 A * 1/2000 Benjamin et al. ..... 439/267
6,019,368 A 2/2000 Sines et al.
6,039,650 A 3/2000 Hill
6,068,258 A 5/2000 Breeding et al.
6,069,564 A 5/2000 Hatano et al.
6,071,190 A 6/2000 Weiss et al.
6,093,103 A 7/2000 McCrea, Jr.
6,117,012 A 9/2000 McCrea, Jr.
6,126,166 A 10/2000 Lorson et al.
6,127,447 A 10/2000 Mitry et al.
6,139,014 A 10/2000 Breeding et al.
6,149,154 A * 11/2000 Grauzer et al. ..... 273/149 R
6,154,131 A 11/2000 Jones et al.
6,165,069 A 12/2000 Sines et al.
6,165,072 A 12/2000 Davis et al.
6,213,310 B1 4/2001 Wennersten et al.
6,217,447 B1 4/2001 Lofink et al.
6,236,223 B1 5/2001 Brady et al.
6,250,632 B1 6/2001 Albrecht
6,254,096 B1 7/2001 Grauzer et al.
6,254,484 B1 7/2001 McCrea, Jr.
6,267,248 B1 7/2001 Johnson et al.
6,267,648 B1 7/2001 Katayama et al.
6,267,671 B1 7/2001 Hogan
6,270,404 B2 8/2001 Sines et al.
6,293,864 B1 9/2001 Romero
6,299,167 B1 10/2001 Sines et al.
6,299,536 B1 10/2001 Hill
6,313,871 B1 11/2001 Schubert
6,325,373 B1 12/2001 Breeding et al.
6,342,830 B1 1/2002 Want et al.
6,346,044 B1 2/2002 McCrea, Jr.
6,361,044 B1 3/2002 Block et al.
6,403,908 B2 6/2002 Stardust et al.
6,443,839 B2 9/2002 Stockdale et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.

(56) References Cited

U.S. PATENT DOCUMENTS

| | | | | |
|---|---|---|---|---|
| 6,530,836 | B2 | 3/2003 | Soltys et al. | |
| 6,530,837 | B2 | 3/2003 | Soltys et al. | |
| 6,532,297 | B1 | 3/2003 | Lindquist | |
| 6,533,276 | B2 | 3/2003 | Soltys et al. | |
| 6,533,662 | B2 | 3/2003 | Soltys et al. | |
| 6,568,678 | B2 * | 5/2003 | Breeding et al. | 273/149 R |
| 6,579,180 | B2 | 6/2003 | Soltys et al. | |
| 6,579,181 | B2 | 6/2003 | Soltys et al. | |
| 6,582,301 | B2 | 6/2003 | Hill | |
| 6,582,302 | B2 | 6/2003 | Romero | |
| 6,585,586 | B1 | 7/2003 | Romero | |
| 6,585,856 | B2 | 7/2003 | Zwick et al. | |
| 6,588,750 | B1 * | 7/2003 | Grauzer et al. | 273/149 R |
| 6,588,751 | B1 * | 7/2003 | Grauzer et al. | 273/149 R |
| 6,595,857 | B2 | 7/2003 | Soltys et al. | |
| 6,616,535 | B1 | 9/2003 | Nishizaki et al. | |
| 6,622,185 | B1 | 9/2003 | Johnson et al. | |
| 6,629,889 | B2 | 10/2003 | Mothwurf | |
| 6,629,894 | B1 | 10/2003 | Purton | |
| 6,637,622 | B1 * | 10/2003 | Robinson | 221/268 |
| 6,638,161 | B2 | 10/2003 | Soltys et al. | |
| 6,645,068 | B1 | 11/2003 | Kelly et al. | |
| 6,645,077 | B2 | 11/2003 | Rowe | |
| 6,651,981 | B2 | 11/2003 | Grauzer et al. | |
| 6,651,982 | B2 | 11/2003 | Grauzer et al. | |
| 6,652,379 | B2 | 11/2003 | Soltys et al. | |
| 6,655,684 | B2 * | 12/2003 | Grauzer et al. | 273/149 R |
| 6,659,460 | B2 | 12/2003 | Blaha et al. | |
| 6,663,490 | B2 | 12/2003 | Soltys et al. | |
| 6,666,768 | B1 | 12/2003 | Akers | |
| 6,676,127 | B2 * | 1/2004 | Johnson et al. | 273/149 R |
| 6,676,517 | B2 | 1/2004 | Beavers | |
| 6,680,843 | B2 * | 1/2004 | Farrow et al. | 361/679.02 |
| 6,685,567 | B2 | 2/2004 | Cockerille et al. | |
| 6,685,568 | B2 | 2/2004 | Soltys et al. | |
| 6,688,979 | B2 | 2/2004 | Soltys et al. | |
| 6,698,756 | B1 | 3/2004 | Baker et al. | |
| 6,712,696 | B2 | 3/2004 | Soltys et al. | |
| 6,719,634 | B2 | 4/2004 | Mishina et al. | |
| 6,726,205 | B1 | 4/2004 | Purton | |
| 6,732,067 | B1 | 5/2004 | Powderly | |
| 6,746,333 | B1 | 6/2004 | Onda et al. | |
| 6,758,751 | B2 | 7/2004 | Soltys et al. | |
| 6,758,757 | B2 | 7/2004 | Luciano, Jr. et al. | |
| 6,774,782 | B2 | 8/2004 | Runyon et al. | |
| 6,804,763 | B1 | 10/2004 | Stockdale et al. | |
| 6,834,251 | B1 | 12/2004 | Fletcher | |
| 6,848,616 | B2 | 2/2005 | Tsirline et al. | |
| 6,848,844 | B2 | 2/2005 | McCue et al. | |
| 6,857,961 | B2 | 2/2005 | Soltys et al. | |
| 6,886,829 | B2 | 5/2005 | Hessing | |
| 6,889,979 | B2 | 5/2005 | Blaha et al. | |
| 6,957,746 | B2 | 10/2005 | Martin et al. | |
| 6,959,925 | B1 | 11/2005 | Baker et al. | |
| 6,959,935 | B2 | 11/2005 | Buhl et al. | |
| 6,964,612 | B2 | 11/2005 | Soltys et al. | |
| 7,011,309 | B2 | 3/2006 | Soltys et al. | |
| 7,029,009 | B2 | 4/2006 | Grauzer et al. | |
| 7,036,818 | B2 | 5/2006 | Grauzer et al. | |
| 7,059,602 | B2 | 6/2006 | Grauzer et al. | |
| 7,066,464 | B2 | 6/2006 | Blad et al. | |
| 7,073,791 | B2 | 7/2006 | Grauzer et al. | |
| 7,084,769 | B2 | 8/2006 | Bauer et al. | |
| 7,106,201 | B2 | 9/2006 | Tuttle | |
| 7,113,094 | B2 | 9/2006 | Garber et al. | |
| 7,114,718 | B2 | 10/2006 | Grauzer et al. | |
| 7,139,108 | B2 | 11/2006 | Andersen et al. | |
| 7,213,812 | B2 | 5/2007 | Schubert | |
| 7,237,969 | B2 | 7/2007 | Bartman | |
| 7,255,344 | B2 | 8/2007 | Grauzer et al. | |
| 7,322,576 | B2 | 1/2008 | Grauzer et al. | |
| 7,338,044 | B2 | 3/2008 | Grauzer et al. | |
| 7,367,561 | B2 | 5/2008 | Blaha et al. | |
| 7,384,044 | B2 | 6/2008 | Grauzer et al. | |
| 7,413,191 | B2 | 8/2008 | Grauzer et al. | |
| 7,448,626 | B2 | 11/2008 | Fleckenstein | |
| 7,510,186 | B2 | 3/2009 | Fleckenstein | |
| 7,523,935 | B2 | 4/2009 | Grauzer et al. | |
| 7,661,676 | B2 | 2/2010 | Smith et al. | |
| 7,766,332 | B2 | 8/2010 | Grauzer et al. | |
| 7,901,285 | B2 | 3/2011 | Tran et al. | |
| 8,141,875 | B2 | 3/2012 | Grauzer et al. | |
| 2001/0036231 | A1 | 11/2001 | Easwar et al. | |
| 2001/0036866 | A1 | 11/2001 | Stockdale et al. | |
| 2002/0107067 | A1 | 8/2002 | McGione et al. | |
| 2002/0142820 | A1 | 10/2002 | Bartlett | |
| 2002/0187830 | A1 | 12/2002 | Stockdale et al. | |
| 2003/0052450 | A1 | 3/2003 | Grauzer et al. | |
| 2003/0064798 | A1 | 4/2003 | Grauzer et al. | |
| 2003/0087694 | A1 | 5/2003 | Storch | |
| 2003/0090059 | A1 | 5/2003 | Grauzer et al. | |
| 2003/0094756 | A1 | 5/2003 | Grauzer et al. | |
| 2003/0195025 | A1 | 10/2003 | Hill | |
| 2004/0067789 | A1 | 4/2004 | Grauzer et al. | |
| 2004/0100026 | A1 | 5/2004 | Haggard | |
| 2004/0116179 | A1 | 6/2004 | Nicely et al. | |
| 2004/0224777 | A1 | 11/2004 | Smith et al. | |
| 2005/0035548 | A1 | 2/2005 | Yoseloff | |
| 2005/0037843 | A1 | 2/2005 | Wells et al. | |
| 2005/0051956 | A1 | 3/2005 | Grauzer et al. | |
| 2005/0104289 | A1 | 5/2005 | Grauzer et al. | |
| 2005/0104290 | A1 | 5/2005 | Grauzer et al. | |
| 2005/0137005 | A1 | 6/2005 | Soltys et al. | |
| 2005/0146093 | A1 | 7/2005 | Grauzer et al. | |
| 2005/0206077 | A1 | 9/2005 | Grauzer et al. | |
| 2005/0242500 | A1 | 11/2005 | Downs, III | |
| 2006/0033269 | A1 | 2/2006 | Grauzer et al. | |
| 2006/0046853 | A1 | 3/2006 | Black | |
| 2006/0063577 | A1 | 3/2006 | Downs, III et al. | |
| 2006/0181022 | A1 | 8/2006 | Grauzer et al. | |
| 2006/0279040 | A1 | 12/2006 | Downs, III et al. | |
| 2007/0006708 | A1 | 1/2007 | Laakso | |
| 2007/0102879 | A1 | 5/2007 | Stasson | |
| 2007/0278739 | A1 | 12/2007 | Swanson | |
| 2008/0006997 | A1 | 1/2008 | Scheper et al. | |
| 2008/0111300 | A1 | 5/2008 | Czyzewski et al. | |
| 2008/0113700 | A1 | 5/2008 | Czyzewski et al. | |
| 2008/0303210 | A1 | 12/2008 | Grauzer et al. | |
| 2009/0191933 | A1 | 7/2009 | French | |
| 2010/0244382 | A1 | 9/2010 | Snow | |
| 2010/0276880 | A1 | 11/2010 | Grauzer et al. | |

FOREIGN PATENT DOCUMENTS

| | | |
|---|---|---|
| WO | 9840136 | 9/1998 |
| WO | WO 00/51076 | 9/1998 |
| WO | 0051076 | 8/2000 |
| WO | WO 87/00764 | 8/2000 |

OTHER PUBLICATIONS

PCT International Search Report for PCT/US07/15035, dated Sep. 29, 2008, 3 pages.

PCT International Search Report for PCT/US07/15036, dated Sep. 23, 2008, 3 pages.

Service Manual/User Manual for Single Deck Shufflers: BG1, BG2 and BG3 by Shuffle Master © 1996.

Scarne's Encyclopedia of Games by John Scarne, 1973, "Super Contract Bridge", p. 153.

Press Release for Alliance Gaming Corp., Jul. 26, 2004—Alliance Gaming Annouces Control With Galaxy Macau for New MindPlay Baccarat Table Technology, http://biz.yahoo.com/prnews.

Tracking the Tables, by Jack Bularsky, Casino Journal, May 2004, vol. 17, No. 5, pp. 44-47.

CD Labeled "Shuffler Art". Attached to this 1449 is a spreadsheet having the names of the individual files within the CD. There is a self-executing function on the CD so that, upon entering the Spreadsheet Table of Contents (Index), individual items may be opened directly from the spreadsheet according to the title of the document (2003).

(56) References Cited

OTHER PUBLICATIONS

DVD Labeled "Luciano Decl. Ex. K". This DVD includes the video taped live Declaration of Mr. Luciano (see list of patents on the 1449 or of record in the file history) taken during preparation of litigation (Oct. 23, 2003).

DVD labeled Morrill Decl. Ex. A:. This DVD includes the video taped live Declaration of Mr. Robert Morrill, a lead trial counsel for the defense, taken during preparation for litigation. He is describing the operation of the Roblejo Prototype device. See Roblejo patent in 1449 or of record (Jan. 15, 2004).

DVD Labeled "Solberg Decl. Ex. C". This DVD includes the video taped live Declaration of Mr. Solberg, a witness for the defense, taken during preparation for litigation (Dec. 22, 2003).

DVD labeled "Exhibit 1". This is a DVD taken by Shuffle Master personnel of the live operation of a Card One2Six™ Shuffler (Oct. 7, 2003).

http://www.google.com/search?tbm=pts&q=Card+handling+devicve+with+input+and+outpu... Jun. 8, 2012.

http://www.google.com/search?tbm=pts&q=shuffling+zone+on+Oopposite+side+of+input+. . . . Jul. 18, 2012.

PCT International Search Report and Written Opinion of the International Searching Authority for PCT/US07/22858, dated Apr. 18, 2008, 7 pages.

Service Manual/User Manual for Single Deck Shufflers: BG1, BG2 and BG3 by Shuffle Master © 1997.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.

PCT International Search Report and Written Opinion of the International Searching Authority for PCT/US11/59797, dated Mar. 27, 2012, 14 pages.

* cited by examiner

AUTOMATIC SYSTEM AND METHODS FOR ACCURATE CARD HANDLING

CROSS-REFERENCE TO RELATED APPLICATIONS

This application is a continuation-in-part of two separate applications, U.S. patent application Ser. No. 11/481,407, filed Jul. 5, 2006, now U.S. Pat. No. 8,342,525, issued Jan. 1, 2013 and U.S. patent application Ser. No. 11/444,167, filed May 31, 2006, now U.S. Pat. No. 8,353,513, issued Jan. 15, 2013 the disclosure of each of which is hereby incorporated herein in their entirety by reference.

TECHNICAL FIELD

The present invention relates to playing card handling systems, particularly card handling systems for shuffling devices that may be used in a casino or card club environment, and particularly playing card shuffling devices that individually move a lowermost card in a stack from one area of the card handling system to another area of the card handling system.

BACKGROUND

Known card feeding systems in a card handling device may include a support surface with pick-off roller(s) that are located within the support surface to remove one card at a time from the bottom of a vertically oriented stack of cards. In this orientation, each card face is in a substantially horizontal plane with the face of a card contacting a back of an adjacent card. The weight of a stack of cards ordinarily provides a sufficient force against the rollers to assure proper movement of most of the cards. But as the stack size decreases after most of the cards have been delivered, the weight of the cards may no longer be sufficient, especially with the last few remaining cards in the stack to assure proper movement of the cards.

U.S. Pat. No. 5,692,748 to Frisco et al. describes a card shuffling device containing free-swinging weights on pivoting arms that applies pressure to the top of stacks of cards that are to be mixed. The lowest card in each stack is in contact with a feed roller that propels the card horizontally, one at a time into a center mixing chamber. As described in Frisco, each of the first and second chambers 34, 36 has an arm 52 pivotally mounted at one end by a pivot 54 to the housing 12 and having at the other end a foot 56. As described therein, when cards are cut and deposited into the first and second chambers 34, 36, the arms 52 pivot as the cards 30 are urged over the front barriers 42 into their nested positions in the first and second chambers 34, 36. As nested on the floors 40 of the first and second chambers 34, 36, the arms 52 remain in contact with the top of the cards 30 to impose a vertical load on the cards 30 to urge them to be contacted by the wheels 48*a*, 48*b*. Proximate the foot 56 of each arm 52, a weight 58 is provided on each of the arms 52. These weights on pivoting arms apply pressure through the stack(s) of cards to assure traction against a pick-off roller at the bottom of the stack.

U.S. Pat. Nos. 6,655,684, 6,588,751, 6,588,750 and 6,149,154 to Grauzer et al.; 6,568,678 and 6,325,373 to Breeding et al.; and 6,254,096 to Grauzer describe a shuffler having a "free-floating," rolling weight that slides along a declining card support surface, toward a set of feed rollers to provide increased force on the rollers to assist in advancing cards. The references also disclose sensors for detecting the presence of cards in a delivery tray or elsewhere.

U.S. Pat. No. 6,637,622 to Robinson describes a card delivery device with a weighted roller for assisting in card removal. A weighted cover is provided on the delivery end of the dealing shoe, covering the next card to be delivered.

U.S. Pat. No. 5,722,893 to Hill et al. describes the use of a weighted block for urging cards toward a discharge end of a shoe. The block provides a force against the cards. The block triggers a sensor when the shoe is empty. The reference specifically states: "In operation, a wedge-shaped block mounted on a heavy stainless steel roller (not shown) in a first position indicates that no cards are in the shoe. When the cards are placed in the shoe, the wedge-shaped block will be placed behind the cards and it and the cards will press against the load switch."

U.S. Pat. No. 5,431,399 to Kelley describes a bridge hand forming device in which cards are placed into an infeed area and are randomly distributed or distributed in a predetermined manner into four separate receiving trays. A weight is shown placed over the cards in the infeed area.

It would be desirable to provide structures and methods to apply a force to individually fed cards to assure consistent feeding, but only when the weight of the stack of cards is insufficient to provide adequate contact with the card feeder to consistently feed cards. It would be desirable for such a mechanism to be retractable as to not interfere with card loading. It would also be desirable to provide a structure and methods that assist in temporarily retaining cards in a position that enables consistent and accurate card handling.

BRIEF SUMMARY

The present invention is a card weight that is pivotally engaged to a structure of a card handling device to provide force against the top of a vertically disposed stack of cards. In a preferred form of the invention, the card weight engages a top card in the stack only when the weight of the stack becomes insufficient to provide adequate contact between the lowermost card in the stack and a card feeder to assure accurate card feeding. A processor determines when the weight engages a top card and controls a drive mechanism that applies a force to the top card, and maintains the force as the cards are fed. Pivoting arms of the present invention may be pivotally mounted to a stationary portion of the card handling device, such as a support frame, or may be mounted to movable components, such as a support structure on a movable elevator that maintains a vertical alignment of a stack of cards as the card stack is lowered into position for shuffling.

Devices of the present invention are particularly useful in assuring accurate feeding of cards from a card feeding area into another area of the device. In some embodiments, pivotal arms of the present invention are integrated into the card shuffling structure, preventing unwanted movement of cards while the cards are being temporarily stored or suspended during shuffling.

Movable weights of the present invention are provided in the form of pivoting arms, and are preferably motor-driven. Sensors used in association with movable weights of the present invention provide signals indicating at least one of a number of cards remaining in the card feeding area, a number of cards fed, weight position, an absence of cards, a presence of cards, a percent shuffle completion or combinations thereof.

In one form of the invention, the weighted arm is retractable. Retractable weights in a retracted position advantageously move out of the card storing area, and avoid interfering with card loading and/or positioning of the cards.

Movable weights may be pivotally attached at a point significantly below the elevation of the top of a complete stack of cards in a card input area of the device. For example, if the card handling device is a multiple deck shuffler, a complete stack of cards might be a six- or eight-deck stack. Activation of a driving mechanism that causes the weight to engage a top card is preferably made in response to an indication of a number of cards left in the card storing area, a number of cards fed from the card storing area, a height of the stack of cards remaining in the card storing area, a percentage feeding completion, a percent shuffle completion or combinations thereof. In this manner, the movable weight is only used when the stack height is smaller, and the weight of the cards can no longer provide a sufficient force between the lowest card in the stack and the feed rollers to assure accurate feeding of individual cards. In one form of the invention, the pivoting arm is driven during card feeding so that an approximately constant force remains on the cards as they are fed.

In some embodiments, pivotal arms are used to retain groups of cards in other storing areas within the card handling device. For example, when cards are shuffled by randomly selecting a point in a vertical stack of cards, gripping cards above the selected point, lowering cards and/or the elevator below the selected point and inserting cards into a gap created beneath the gripped cards, a pivotal arm may be used to prevent cards from popping upwardly out of the grippers. Pivotal arms prevent unwanted movement of cards but normally only contact cards that are moving in an unwanted manner.

A method of handling playing cards is disclosed. The method comprises the step of positioning a vertically disposed stack of playing cards into a card storing area of a card handling device. A card moving system is provided. The card moving system moves cards individually out of the card storing area and into a second area from the bottom of the stack. According to the method, at least one parameter is measured, the at least one parameter is selected from the group consisting of: a number of cards fed from the card storing area, a number of cards remaining in the card storing area, a height of the stack of cards in the card storing area, a percentage feeding completion, or a percentage shuffle completion. When a predetermined value of a parameter is measured, the method includes providing a force to an uppermost card in the stack in the card storing area, increasing a force between a lowest card in the stack and the card moving system.

A method of handling playing cards is disclosed. The method comprises a step of positioning a plurality of stacked cards in a card handling area of a card handling device. The method also includes the steps of selecting a location to divide the stacked cards and creating a gap in the stacked cards at the selected location by suspending all cards above the selected location in the stacked cards. When a number of suspended cards is at or below a predetermined number, the method includes rotating a pivotal arm so that the arm is positioned proximate to and above a top card in the suspended cards to prevent cards from moving out of suspension.

DETAILED DESCRIPTION

Figure 1:
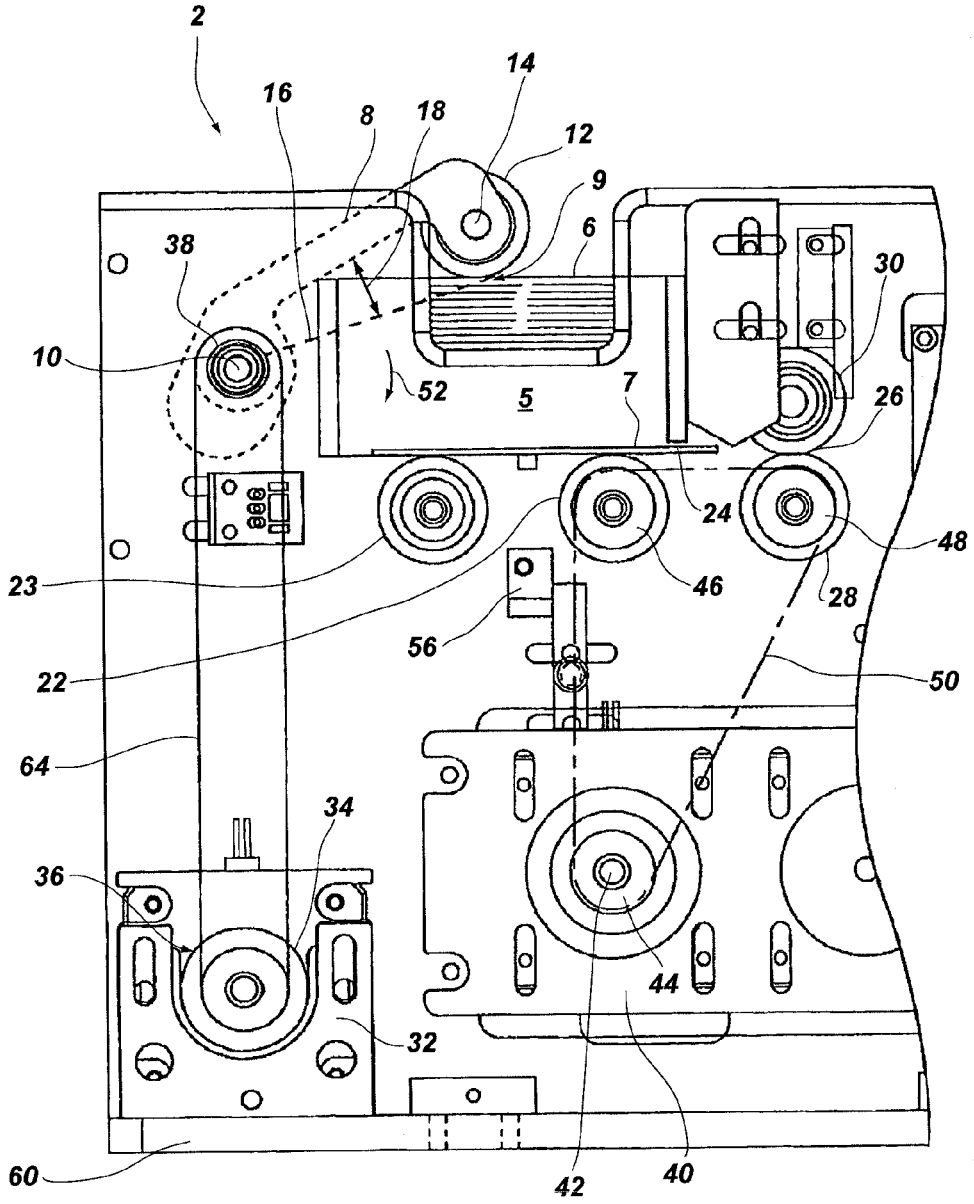
FIG. 1 shows a first side elevational view of a first exemplary card handling system of the present invention.

Playing card handling devices of the present invention are disclosed. The device comprises a card storing area that supports a stack of playing cards, the card storing area having a playing card support surface. The playing card handling device has a card removing system that removes playing cards individually from the bottom of the stack. A pivoting arm is automatically moved by a motor between at least two positions, wherein in a first position the end of the arm opposite a pivot is disengaged from a playing card at the top of the stack and in a second position the end of the arm is engaged with a playing card at the top of the stack. The device also includes a processor that directs movement of the pivoting aim between at least a first and second position when information is known to the processor that a predetermined number of cards is present in the card storing area of the card handling device. The processor additionally controls a drive mechanism, such as a stepper motor, to continue to move the pivotal weight in a manner that retains a force on the cards as the cards are fed.

Card handling devices of the present invention may include card dispensing shoes, automatic card shufflers, card set verification devices, card marking devices, card decommissioning devices, card sorting and packing devices and any other type of known card handling device. A card shuffling system may be present within the playing card handling device.

Pivotal weights of the present invention may be positioned in the card infeed area of a card handling device. A preferable movable weight is a pivotally mounted pivoting arm. Card storing areas may comprise card infeed areas for inserting cards. Other card storing areas may be intermediate storage areas within the card handling device. For example, when the card handling device is a shuffler, one or more temporary card storing areas may be located within the card shuffler.

In one embodiment of the invention, the processor causes the pivoting arm to rotate into a card contacting position when a predetermined number of between 8 and 20 cards remain in the card storage area. Prior to delivering the last 8 to 20 cards, the pivoting arm remains disengaged from the top card in the stack. It is to be understood that the weight continues to rotate during card feeding to maintain a force between the cards and a card feeder.

In some embodiments, the card handling device includes a card removing system and the card removing system comprises a pick-off roller. The movement of the pivoting arm into the engaged position applies pressure against a playing card at the top of the stack and also provides force between a lowest playing card in the stack and the pick-off roller during card feeding. Card handling devices of the present invention may include one or more sensors to measure at least a position or a degree of rotational position of the pivoting arm, or the number of cards fed, a number of cards remaining, a percent shuffle completion, and the like. Devices of the present invention may alternatively include a counter for maintaining a count of playing cards in the playing card storing area during operation of the device.

Card handling devices of the present invention are processor controlled. The processor may cause the pivoting arm to pivot into an engaged position when a card count reaches a predetermined threshold amount, such as between 8 and 20 cards, and preferably about 10 cards. The processor of examples of the invention may be in communication with at least one sensor. For example, a card present sensor in a discharge tray or a pivoting arm position sensor may provide signals to the processor and use the signals to determine when to activate the pivoting arm, or the processor is in communication with a device that counts cards fed, or cards remaining in the infeed tray.

Playing card handling devices of the present invention may include a shuffling system within the playing card handling device, wherein the shuffling system comprises a playing card collection area where cards are moved individually from a playing card infeed area to the playing card collection area, and a pivoting arm is located in the playing card infeed area, wherein the pivoting arm moves automatically from an engaged position to a disengaged position when the card infeed area is empty, and moves from the disengaged position to the engaged position when a number of cards in the card infeed area falls to a predetermined number. In some embodiments of the invention, a sensor sends a signal to the processor indicating a number of playing cards remaining in at least one storage area of the playing card collection area and when that number of playing cards in the at least one storage area of the playing card collection area is a predetermined number, the pivoting arm moves to a second engaged position. Once engaged, the arm continues to pivot in response to being driven while cards are continually fed.

When the card handling device is a card shuffler, a set of grippers may be provided in the card collection area. The shuffler may further comprise a stationary card feeder and an elevator, wherein cards are elevated to an elevation of the grippers and the grippers grasp card edges of a group of cards, and when the elevator is lowered, at least one card is suspended and a gap is created below the suspended at least one card and a card support surface of the elevator or any cards on the elevator for insertion of a next card. Exemplary shufflers may be processor controlled, and may further be equipped with a random number generator to randomly determine a number of cards to be suspended by means of the grippers. The processor may be configured so that when the random number generator provides a number of suspended playing cards equal to or less than a predetermined number, the processor directs a pivoting arm to rotate so that an end of the arm distal from a pivot point moves into a position proximate to and above a top of the uppermost suspended playing card or cards.

The present invention may also be characterized as a card handling device that includes a card infeed area that supports a stack of playing cards that has a playing card support surface. The card handling device includes a card removing system that removes playing cards individually from the bottom of the stack and delivers cards into a playing card collection area. The playing card collection area is a portion of the device where playing cards are received one at a time after being removed individually from the bottom of the stack. A pivoting arm is provided that moves between a first position where a distal end of the pivoting arm is not in contact with any playing cards in the playing card collection area and a second position where the distal end of the pivoting arm is in contact with a top card in the playing card collection area. A motor drives the pivoting arm causing the arm to continue to rotate during card feeding. A processor provides signals to the motor to move the pivoting arm between the first position and the second position in response to information received from a playing card counting system. The present invention also includes a playing card counting system that identifies total numbers of playing cards in at least one area in the playing card collection system.

In some embodiments, the playing card system comprises a random number generator that provides a random number of cards to be separated from an entire set of cards as an uppermost subset of playing cards, and it is the random number of playing cards in the uppermost subset of playing cards that is compared to a predetermined number of playing cards to determine whether the pivoting arm should be moved into a position proximate a top surface of the suspended cards. In other embodiments, the pivoting arm is moved into a position proximate the suspended cards regardless of card count or other sensed information.

A playing card handling device is disclosed, comprising a card infeed area that supports a stack of playing cards that has a playing card support surface. A card removing system that removes playing cards individually from the bottom of the stack is provided. A playing card collection area is provided where playing cards are received one at a time after being removed individually from the bottom of the stack. A first pivoting arm is movable between a first position where a distal end of the pivoting arm is not in contact with any playing cards in the playing card collection area and a second position where the distal end of the pivoting arm is in contact with a top card in the playing card collection area. According to the invention, a motor is provided to pivot the first pivoting arm. Pivoting preferably continues during card feeding. A processor in the card handling device provides signals to the motor to move the first pivoting arm between the first position and the second position.

A playing card counting system that identifies total numbers of playing cards remaining in at least one area in the playing card collection system is provided. The playing card counting system comprises a random number generator that provides a random number of cards to be separated from an entire set of cards as an uppermost subset of playing cards, and it is the random number of playing cards in the uppermost subset of playing cards that is compared to a predetermined number of playing cards to determine whether a pivoting arm should be rotated to a position proximate a top separated card in the first position or in the second position.

The present invention is a method of handling playing cards. The method comprises a step of positioning a vertically disposed stack of playing cards into a card storing area of a card handling device. A card moving system is provided that moves cards individually out of the card storing area and into a second area from the bottom of the stack. Included in the method is a step of measuring at least one parameter selected from the group consisting of: a number of cards fed from the card storing area, a number of cards remaining in the card storing area, a height of the stack of cards in the card storing area and a percent of cards fed. According to the method, when a predetermined value of a parameter is measured, a force is provided to an uppermost card in the stack in the card storing area, increasing a force between a lowest card in the stack and the card moving system. This added force remains on the cards during feeding, and assures accurate transfer of cards out of the card storing area of the card handling device.

In a preferred embodiment, the first area is a card infeed tray and the second area is a card shuffling area. Cards stored in the card shuffling area may be stored temporarily as part of a shuffling process. When cards are temporarily stored in the second area, methods of the present invention include the step of shuffling the cards. In some embodiments of the invention, shuffling can be accomplished by separating the stack in a randomly determined location, creating a gap in the stack at the randomly determined location, inserting a card, and then repeating the steps of randomly determining a location, creating a gap and inserting a card.

Methods of the present invention include methods of handling playing cards, comprising the step of positioning a plurality of stacked cards in a card handling area. According to the method, a location to divide the stack is selected. Preferably, this selection step is accomplished by means of a processor, and the use of a random number generator in communication with the processor. Random number generators may be in the form of software, hardware or the combination of software and hardware. According to the method, a gap is created at the selected location by suspending all cards above the selected location in the stack. When a number of suspended cards is at or below a predetermined number, a pivotal arm is rotated to a position proximate a top surface of a top card in the suspended stack to prevent cards from moving out of suspension. In some embodiments, the gap created when the cards are suspended is accomplished by raising the stack of cards by means of an elevator to a stationary pair of opposing grippers. At least one of the grippers in a gripper pair moves horizontally to grasp the card edges. If too few cards are in the grippers, the cards bow and have a tendency to pop out of the grippers. By applying a blocking force above to a top card face, cards can be retained in the temporary storing location. Without the pivotal arm in place, if cards do pop out of the grippers, they may become vertically aligned and fall into a lower portion of the card shuffling area, where they remain until the cards are manually removed.

When the card handling device includes a shuffling mechanism, according to the method of the present invention, it is desirable to provide a step of providing a stack of cards in a card storing area, and moving cards individually into the card handling area of the shuffling mechanism. Cards placed in the card handling device may be fed individually from a bottom of a vertically positioned stack in the card storing area.

According to the method, when a gap is created in the cards to allow the insertion of the next card, an elevator may be provided to raise the stack to a predetermined elevation so that stationary grippers can grasp an upper portion of the stack. Advantageously, an elevator may be provided to raise the stack. The predetermined location may be randomly selected by the processor, or the random number generator that is in data communication with the processor.

According to a preferred method, a gap is created in the stack by elevating cards to a preselected elevation, grasping a number of cards above the selected location and then lowering the cards that were not grasped to create an opening for insertion of a next card. An elevator is preferably used for raising and lowering the cards. The pivotal arm may be rotated back to a retracted position either prior to, during or after grippers release the cards. Preferably, the pivotal arm is rotated back just prior to releasing cards from the grippers.

Structures of the present invention may be used in combination with a variety of card handling devices, such as mechanized card shoes, card set checking devices, automatic card shufflers, card sorting devices, card decommissioning devices, and the like. Although preferred structures are used in connection with substantially vertical card stacks with gravity feed systems, pivotal arms of the present invention may be used to apply forces to cards that are in horizontally aligned stacks, and stacks that are positioned at an angle with respect to the vertical. For example, it might be advantageous to provide a card stack that is tipped 5 degrees to 10 degrees with respect to the vertical so that manual card stack insertion and alignment is made easier.

Structures of the present invention are useful to incorporate into a card input or infeed section of a card handling device, or in other areas of the device that hold cards, regardless of how much time the cards remain in a particular area of the card handling device. For example, pivotal arms of the present invention may be used to assist in accurately retaining cards in a temporary storing area, where cards are stored as part of a shuffling process. Other storage areas hold cards in a card input area, in a completed processed set area, and in other temporary storage locations, regardless of the duration of the storage time. It can be readily appreciated that stacks of cards may be formed in various locations within the card handling device and the present technology may also be used to move cards from internally formed stacks within the device to another area of the device, such as an output tray, for example.

Although structures and methods of the present invention may be applied to vertically disposed stacks of cards that retain card surfaces in a horizontal plane in adjacent card face to card back relationship, the invention may be used to facilitate card movement from stacks that are horizontally oriented, or are oriented at an angle with respect to the horizontal or vertical. For example, structures and methods of the present invention may be also used in connection with delivering cards on a declining surface in a shoe.

Suitable shuffling mechanisms that may be used in connection with the present invention encompass many different types of shuffling technologies, such as random card ejection technology (i.e., U.S. Pat. No. 7,066,464 to Blad et al.), random distribution of cards into compartments within a stack of cards (i.e., U.S. Pat. No. 6,254,096 to Grauzer), distribution of cards into a circular carousel of compartments (i.e., U.S. Pat. No. 6,659,460 to Blaha et al.), distribution of cards into a fan array of compartments, distribution of cards into an opening that was randomly selected and then created in a stack (i.e., U.S. Pat. No. 6,651,981 to Grauzer et al.), etc. The disclosure of each of these patents is hereby incorporated herein by reference in its entirety.

In a first embodiment of the present technology, as shown in FIG. 1, a set of playing cards 6 is placed as a vertically disposed stack into a card infeed area 5 of a card handling device. Although the cards 6 are vertically stacked (with the face of each card being in a horizontal plane) within the card infeed area 5 in this embodiment, the stack of cards 6 may also be slightly angled (e.g., +/−30 degrees from horizontal). The cards 6 are stacked in the card infeed area 5 and then the cards 6 are removed one at a time from the bottom of the set of cards 6 by means of pick-off rollers 22, 23. Cards 6 are individually moved to speed-up roller pair 28, 30 where they are delivered into a shuffling mechanism (not shown). An exemplary shuffling mechanism for randomizing the stack of cards 6 is described in U.S. Pat. No. 6,651,981 to Grauzer et al. Preferably, the cards 6 are placed in the card infeed area 5 face down, so that no card value is exposed to the players or dealer, but this is not of functional importance to the practice of the present technology.

Systems that move cards out of a substantially vertically disposed stack of cards from the bottom of the stack are referred to in the casino supply industry as "gravity feed" systems. In gravity feed systems, playing cards are removed from the bottom of the stack, and the weight of the stack applies a downward force to the card moving structure. Typically, a friction wheel 22 (referred to as a pick-off roller) extends upwardly and into the bottom of the playing card input chamber, and into contact with a lowermost card in the stack. Rotation of the pick-off roller 22 provides a driving force against the playing card, forcing the playing card horizontally out of the card input chamber and toward the shuffling area.

Figure 2:
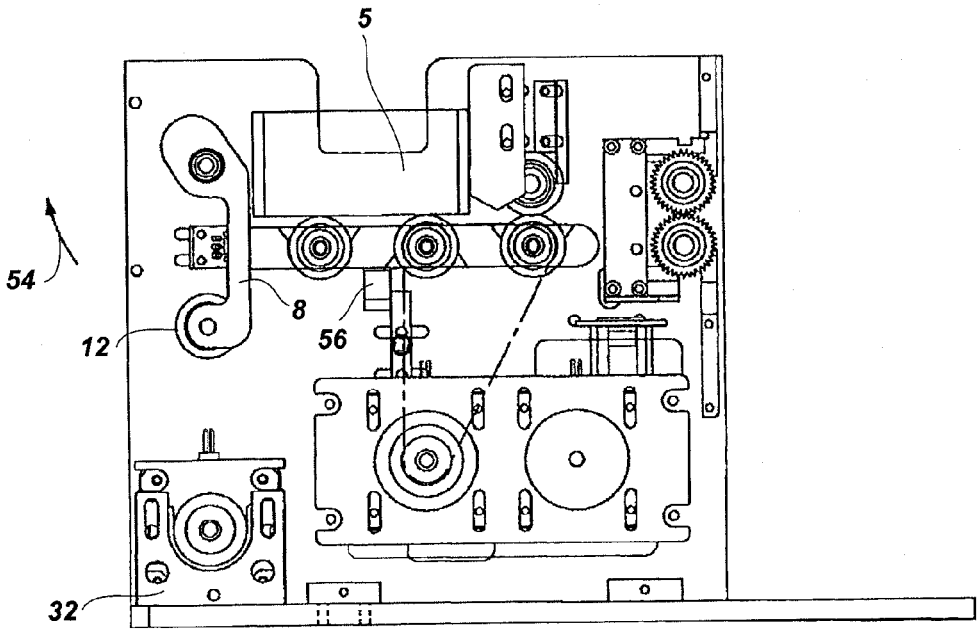
FIG. 2 shows a second side elevational view of the first exemplary card handling system.

A pivoting arm 8 is fixedly mounted to a frame 60 at pivot point 10. In a card engaging position, as shown in FIG. 1, roller 12 contacts an upper surface of the top card in the stack of cards 6, applying a downward force on the stack of cards 6. The pivoting arm 8 is rotated by means of a stepper motor 32 that drives pulley 36, which in turn drives pulley 38 by means of belt 64. As shown in FIG. 2, the pivoting arm 8 in a retracted position is clear of the card infeed area 5 when in a card disengaging position. The pivoting arm 8 does not interfere with card loading, because the entire pivoting arm 8 is removed from the card infeed area 5.

Embodiments of the card handling device of the present disclosure incorporate at least one sensor to indicate the position or a degree of rotation of the pivoting arm, or incorporate other sensors to indicate a number of cards remaining in the card storing area. The position of the movable weight in some instances can be used as an indication of whether or not cards are present in the card storage area. In other embodiments, a card present sensor is also provided in the card storing area to indicate an absence or presence of one or more cards.

Embodiments of the present invention are used in connection with card handling devices that maintain a count of playing cards in the playing card infeed area during card handling operation of the device. Card handling devices are preferably processor controlled. The processor may be in communication with at least one sensor, such as a pivoting arm position sensor, a card present sensor, a card counter or other sensor. The processor is capable of determining that a predetermined maximum number of playing cards has been reached after removal of a portion of the set of playing cards from the playing card infeed area. In response to meeting this condition, the processor causes activation of a drive mechanism to pivot the pivoting arm into a card engaging position. Pivoting arms of the present invention advantageously apply more force to a top card in the stack than known card weight systems. In addition to the weight of the arm, additional forces are applied by the drive system during card moving.

Within the card handling device, there may be a shuffling system that moves cards individually from the playing card infeed area into a card shuffling mechanism. During shuffling, cards may be temporarily stored in a temporary card storing area. A random number generator determines a location in the stack to suspend cards. In most instances, the stack is divided into two sub-stacks. In other instances, all of the cards, or none of the cards are suspended. This determination, in turn, determines how many cards are temporarily stored in the area of suspension. When a threshold number of cards or fewer is present in the temporary storing area, a pivotal arm is activated to move the arm over the top of the suspended cards, close enough to the cards to prevent the cards from flipping over if a card pops out of the grippers. In one embodiment, this proximate relationship is a few card thicknesses. In other examples, the distance is between one card thickness and a dimension of a card length or width. During operation, the pivotal arm provides a barrier to stop cards from flipping over. Unless cards pop out of the grippers, no contact is made between the arm and the cards. For example, a vertical stack of cards may be temporarily stored in a pair of spaced-apart horizontally reciprocating grippers and a pivotal arm may be provided above the gripped stack to stop cards that have popped out of the grippers from flipping over and falling vertically down the side of the stack. A suitable gripper set grasps cards by moving horizontally while the structure is fixed in the vertical direction. Shortly before, during or after the gripper is released, the processor directs the pivotal arm to disengage the cards. In other embodiments, the pivotal arm remains in the engaged position when the grippers release the cards.

The pivotal arm of the present invention may be positioned over cards in the grippers at all times, or when relatively few cards are gripped. When there are a small number of cards in the grippers, the force of the grippers is more likely to cause cards to bow and pop out and flip. It may be desirable to cause the flipper to move into a "bracing" position when a threshold number of cards or fewer are gripped.

For example, a threshold number of gripped cards may be ten cards. The number of cards defining the threshold amount can vary, depending on the type of cards, card weight, and frictional characteristics of the card. For example, plastic cards are typically thicker and more rigid than paper cards. In that instance, the threshold number of cards could be lower than when the device is programmed to process paper cards of a certain manufacturer. In general, suitable threshold amounts for a variety of playing cards used in U.S. casinos would be between eight and fourteen cards, and preferably about ten cards.

When the random number generator selects a location in the stack to separate the cards, the processor determines how many cards are retained in the grippers. Alternatively, the processor selects a card in the stack and determines whether that card and the cards above that card should be gripped. Or, the selected card is determined to be part of the lower sub-stack. If the number of gripped cards is less than or equal to ten cards, for example, the pivotal arm is activated to move into a bracing position.

Referring back to FIGS. 1 and 2, the use of a pivoting arm 8 with a center of rotation of the pivoting arm 8 that is below a point that is spaced above, and preferably at least 15 mm above, the card support surface in the card infeed area 5 is illustrated. The center of rotation may alternatively be located above the playing card support surface by at least 18 mm, at least 20 mm or at least 25 mm or more. Preferably, the pivot point 10 is also spaced apart from the card infeed area 5. The ability to provide this elevation of the pivot point 10 of the pivoting arm 8 in relation to the playing card surface allows for a lower height to the system, better consistency of weight against the cards, and the like. The relative elevation is provided by having a pivoting arm 8 that extends above the pivot point 10 on one end of the pivoting arm 8 and also above a playing card contact point 9 on the other end of the pivoting aim 8. This creates an elevated middle area or recess in the pivoting arm 8, which can extend over the edge of the playing cards 6 in the card infeed area 5 to avoid contact with those cards. In other words, the pivoting arm 8 of the pivotal weight is advantageously U-shaped.

A second concept developed herein is the use of a motor-driven pivoting arm 8 that controls the height of the contact point 9 and/or the force at the contact point 9 and/or the retraction/lowering of the pivoting arm 8 and/or other actions by the pivoting arm 8 with respect to the loading, unloading and shuffling process, including addressing any card jam events. FIG. 1 shows a sectioned or cutaway side elevational view of a playing card feeding portion 2 of a playing card handling system. The height of a set of cards (e.g., a single deck of cards is illustrated) 6 is shown in the playing card receiving or infeed area 5. A pivoting arm 8 is shown with a roller 12 pivotally mounted about rotational shaft 14 at the contact end of the pivoting arm 8 resting on the top of the set of cards 6. This may represent a locked or controlled position of the pivoting arm 8. The pivoting arm 8 pivots about pivot point 10 and the roller 12 pivots about rotational shaft 14. A dashed line 16 is shown between the pivot point 10 and the lower surface of the roller 12. As can be seen, this dashed line 16 intersects the height of the playing cards 6, which would mean that the traditional straight weighted arm (as taught by Frisco, above) would rest against the edge of the cards and possibly interfere with, damage or mark the cards. As is shown in FIG. 1, there is a significant gap 18 above the dashed line 16 and the height of the set of playing cards 6 in the card infeed area 5. This structure prevents the need for elevating the pivot point 10 of the pivoting arm 8 above the height of the uppermost card in the stack of cards 6. When the pivoting arm 8 and pivot point 10 have to be so elevated, the overall height of the shuffler is increased. Additionally, other functioning parts of the arm system, (i.e., the belts if used, drive wheels and the shaft, for example) may be exposed and subject to damage from the exposure.

A bottommost playing card 7 is driven by pick-off rollers 22, 23 through an outlet slot 24 in the bottom of the playing card infeed area 5. The playing card 7 driven though the slot 24 then engages speed-up rollers 28 and 30, which form a nip 26 that moves the playing card 7 into the shuffling area of the shuffler (not shown). A motor 40 drives shaft 42. Shaft 42 rotates, causing sheaves 44, 46 and 48 to rotate. An endless member 50 contacts sheaves 44, 46 and 48.

A stepper motor 32 is provided to drive a drive wheel 34 with drive belt 64 that also engages pulley 38, causing the weighted pivoting arm 8 to pivot. Once the last card exits the card infeed area 5, the pivoting arm 8 rotates downwardly in a direction of arrow 52 into a retracted position. In the retracted position, as shown in FIG. 2, the pivoting arm 8 is completely free of the card infeed area 5. Cards can be manually loaded without any interference from the pivoting arm 8.

After the next group of cards is inserted into the card infeed area 5, the pivoting arm 8 continues to rotate in a clockwise direction, as shown by arrow 54 (FIG. 2), until the roller 12 comes back into contact with the top card in the next stack. Alternatively, the pivoting arm 8 rotates in an opposite direction to a position that is free of the card infeed area (not shown). The card weight advantageously retracts and does not interfere with the loading of cards. A card present sensor 56 may send a signal to the processor (not shown) that in turn actuates stepper motor 32 to rotate pivoting arm 8 into the "card engaged" position.

Operation of the pivoting arm 8 may be controlled by a processor (not shown) and/or react to sensors or be free in its pivoting. When the pivoting arm 8 has the gap 18 built in, the pivoting arm 8 may pivot and retain cards under its own weight. Because of the initial elevation of the pivoting arm 8 (as shown by the angle of dashed line 16 with respect to the horizontal), the pivoting arm 8 will initially (under its own weight) pivot first toward the horizontal and then slightly below the horizontal. The contact point 9 between the roller 12 and the top surface of the uppermost playing card will also move from a non-centered position toward a more centered position, as the height of the stack of playing cards 6 changes. This orientation of the pivoting arm 8 with a roller 12 thereon reduces damage to surfaces of the cards that are contacted by the roller 12.

When the pivoting arm 8 is motor driven, an intelligent drive system (as with a processor, microprocessor or computer, with "processor" used generically) may assist in driving the positioning of the pivoting arm 8 and apply contact pressure between the pivoting arm 8 and the top of the set of playing cards 6 in the card infeed area 5. The application of pressure can be accomplished a number of ways. For example, the processor may instruct the stepper motor 32 to move a defined number of steps or positions for each fed card.

One mode of operation of the intelligent drive system may include some or all of the following features. When no playing cards are present in the chamber (signals or data of which may be obtained from card present sensors or cameras), the processor may direct the pivoting arm 8 to be rotated into a retracted position to facilitate depositing of the playing cards by hand. When the processor is provided with information such as signals or data indicating that playing cards 6 are positioned in the card infeed area 5, the pivoting arm 8 is rotated (clockwise in FIG. 1) until contact is sufficiently made with the top of playing cards 6. This sensing may be accomplished in numerous ways, as with a contact sensor (not shown) in the rotational shaft 14, tension reduction sensed in the pulley 36 through the stepper motor 32, cameras or optical sensors (not shown) in the card infeed area 5, and the like. Once contact is made, the pivoting arm 8 may remain under tension by the drive system or become free in its rotating by disengaging gearing or pulleys (e.g., pulley 36) driving the pivoting arm 8. Alternatively, upon removal of cards, the processor will adjust the tension in the pulley 36 to adjust the contact force of the roller 12 against playing cards 6. This adjustment may be done continually, periodically or at specific event occurrences, such as the movement of a single card, the movement of a specific number of cards out of the card infeed area 5, or the like. The force applied by the roller 12 to the top playing cards should usually be sufficient that removal of a single card from the bottom of the set of cards 6 will not completely remove the force applied by the roller 12.

The system may also indicate the absence of playing cards in the card infeed area 5. For example, a card present sensor 56 may indicate that no cards are in the card infeed area 5. The system may utilize the same sensors that indicate the presence of cards in the playing card infeed area 5 to indicate the absence of cards in the card infeed area 5. Alternatively, the arm itself may be associated with various sensors to indicate the absence of playing cards in the card input chamber. For example, when there are no cards in the chamber, the arm may continue to rotate clockwise to a "retracted" position. The arm (as associated sensors or systems that measure the degree of rotation of the arm) may be preprogrammed or trained to recognize the lowest position of the arm with a single card in the chamber. When that position or degree of rotation is subsequently exceeded, a signal will be sent to send the pivoting arm 8 to the lowest position (shown in FIG. 2).

As noted above, the end of the arm is provided with a roller, but a low-friction surface may also be provided in place of the roller. For example, a smooth, flat, rounded edge with a polymeric coating (e.g., fluorinated polymer, polysiloxane polymer, polyurethane, etc.) can provide a low-friction surface that will slide over the playing cards without scratching the cards.

Some of the properties of the exemplary pivotally mounted card weight arm with the roller or glide surface thereon are: essentially downward (toward the cards) a free-swinging or controlled arm, with a lower edge gap that extends over edges of playing cards when the arm is elevated; a sensing device identifying the position of the arm along its path of movement, the sensed position including sensing of a position of the arm or contact of the arm, indicating the presence, absence or approximate amount (number) of cards in the card infeed area, the sensor signaling a processor that commands a motor attached to a belt that can motivate the weighted arm into a contact position and a retracted position; and an automatic sequence that rotates the weighted arm into a retracted position to allow insertion of additional cards into the shuffler.

Although the pivoting arm may move freely about the pivot point, in one form of the invention, the pivoting arm is spring-loaded such that a force must be applied to the arm in order to raise the arm high enough to insert cards. In another form of the invention, the card feeding device includes a computer-controlled drive system. An exemplary drive system includes a motor that rotates the pivoting arm about the pivot point (or pivotal shaft). In a first engaged position, a contact end of the pivoting arm applies a downward force to the stack of cards. The drive, the weight of the arm, or both apply a downward force to the cards. When the pivoting arm is rotated by a motorized drive system, the motor positions the pivoting arm to apply pressure against the card at the top of the stack.

Sensors may be provided to signal the microprocessor to instruct the drive system to rotate the pivoting arm. An example of one sensor is a position sensor located on the pivotal shaft. This sensor provides an indication of the position or degree of rotation of the pivoting arm. Each provided sensor is in communication with the processor. The processor may also instruct the motor to alter the position of the pivoting arm upon receiving a sensor signal. Another example of a suitable sensor is a card present sensor located on or beneath the card support surface.

One preferred drive motor is a stepper motor. The stepper motor may rotate in two directions or just in a single direction. When the motor rotates the pivoting arm in a single direction, the pivoting arm is capable of moving from a recessed position back into a card engaging position without interfering with card loading. Preferably, the pivoting arm is completely concealed within an interior of the machine when in the recessed position. When in the recessed position, no part of the pivoting arm extends into the card infeed area, leaving the area free for typical card loading.

Figure 3:
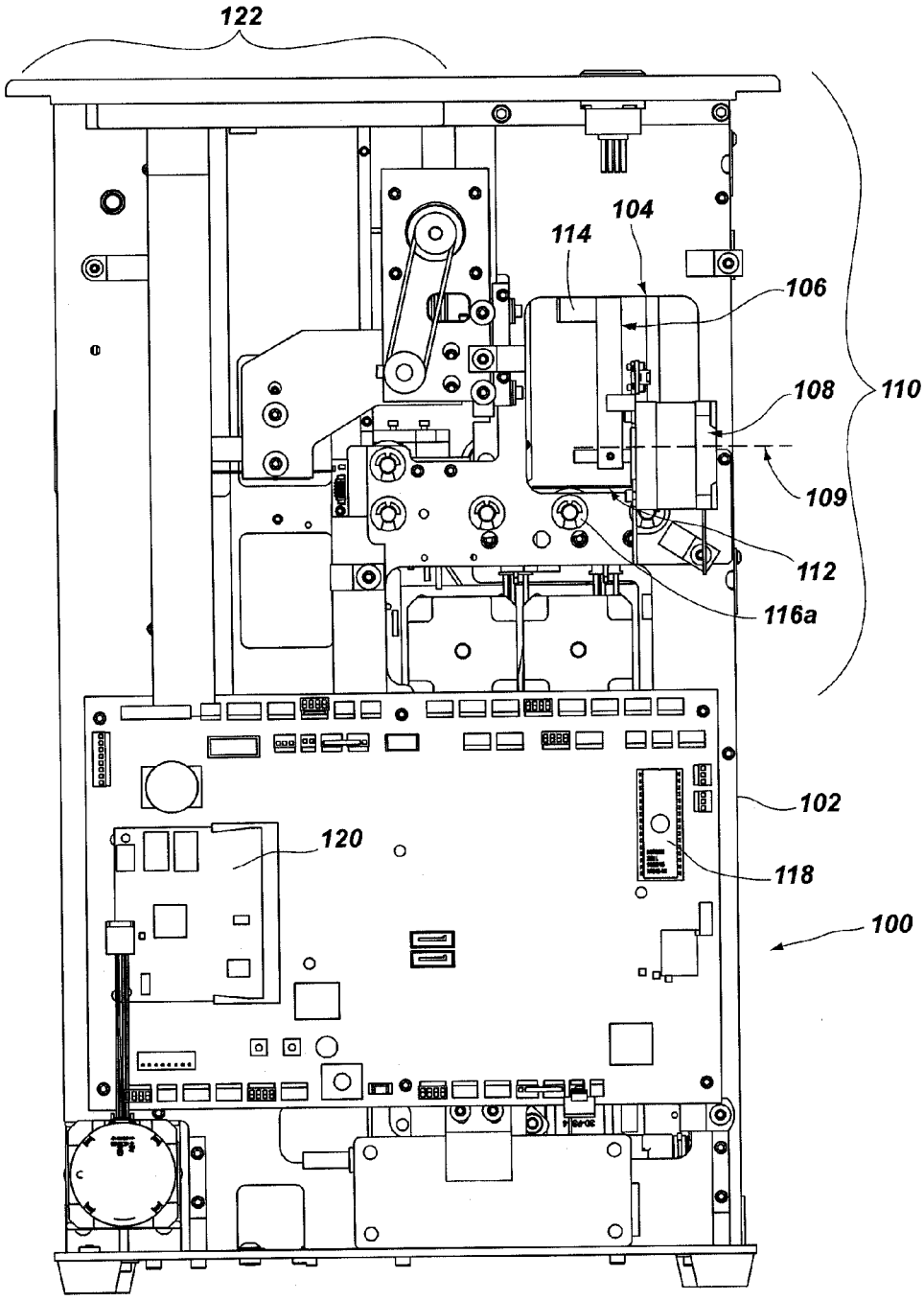
FIG. 3 shows a front elevational view of a second exemplary card handling device of the present invention.

Reference to FIGS. 3 through 6 shows an alternative embodiment that employs the technology of the present invention. FIG. 3 shows a frontal elevational view of shuffler 100 with the housing removed. The shuffler 100 has a support structure 102 adjacent to a card infeed area 110 of the shuffler 100. Cards (not shown) are placed within card receiving chamber 104 through an access opening (not shown) in an upper surface of the shuffler 100 and the card stack is seated at its lowest level 112 within the card receiving chamber 104. The lowest level 112 represents a card support surface. As cards are removed one at a time from the card receiving chamber 104, and moved to a shuffling area 122, the number of cards removed is counted. The number of original cards input into the shuffler 100 is known (by preprogramming or user input at the time of the input), and by deducting the number of cards removed from the card receiving chamber 104, the number of cards remaining in the card receiving chamber 104 are known. A processor 120 is preprogrammed to direct activation and position of a card weight motor 108, which card weight motor 108 causes a card weight arm 106 to rotate (into the direction of the paper) about axis 109 from its raised position (shown) to a card engaging position (not shown) where it presses against the flat top of cards in the card receiving chamber 104. The mass of the arm 106 and, preferably, also light spring pressure from an arm extension or extended spring element 114, applies force from the top of the predetermined number of cards in the card receiving chamber 104 through the cards, to a lowermost card in the card receiving chamber 104 so that the lowermost card is pressed against a first pick-off roller 116*a*. A random number generator module 118, described in more detail below, is in communication with the processor 120 and is also shown in FIG. 3.

Figure 4:
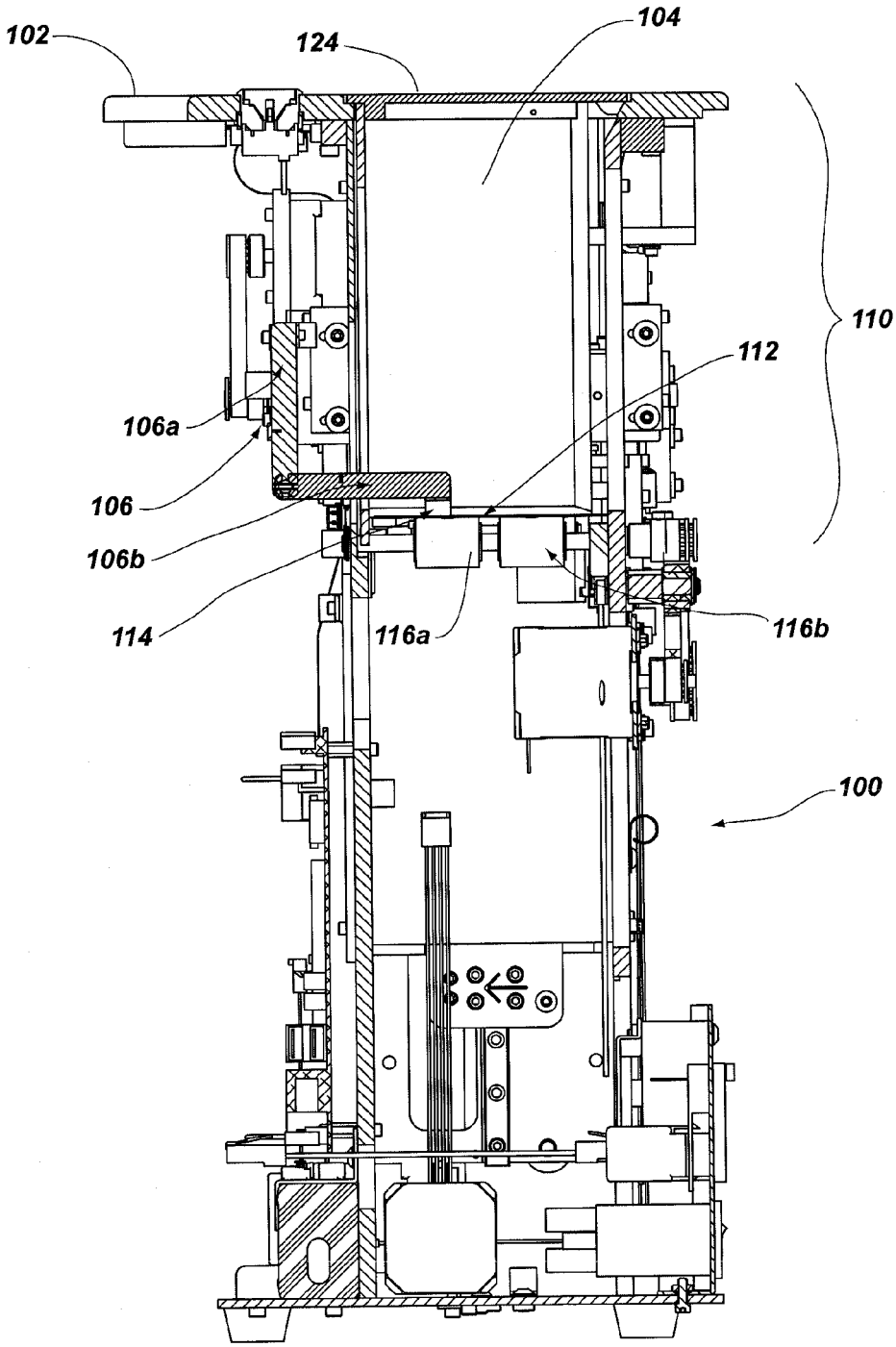
FIG. 4 shows a first side elevational view of the second exemplary card handling device of the present invention.

FIG. 4 shows a side elevational view of the shuffler 100 with the housing removed. Above the card receiving chamber 104 where playing cards are fed into the shuffler 100 is a pivoting lid 124. An elevated pivoting card weight arm 106 is shown in a retracted or "disengaged" position 106*a*, outside of the card receiving chamber 104. Also shown in FIG. 4 is the same card weight arm 106, or pivotal arm, in a lowered or "engaged" position 106*b*. Of course these two positions 106*a*, 106*b* cannot be present at the same time, as there is a single arm (106 of FIG. 3), but these views show the movement of the arm 106 between positions 106*a* and 106*b*. The spring element 114 is shown in contact with the first pick-off roller 116*a* and not in contact with the axially aligned second pick-off roller 116*b*. One suitable spring is formed of plastic. Other materials, such as metallic materials, may be used to form a spring. The lowest level 112 of the card receiving chamber 104 can be seen with no playing cards in the card receiving chamber 104. This is why the spring element 114 is in contact with the pick-off roller 116*a*. All reference numerals in FIG. 4 that are the same as reference numerals in FIG. 3 show similar components of the shuffler 100. When a predetermined number of cards (or fewer) are left in card receiving chamber 104 during card feeding, card weight arm 106 moves from the card disengaged position 106*a* to the card engaged position 106*b*.

Figure 5:
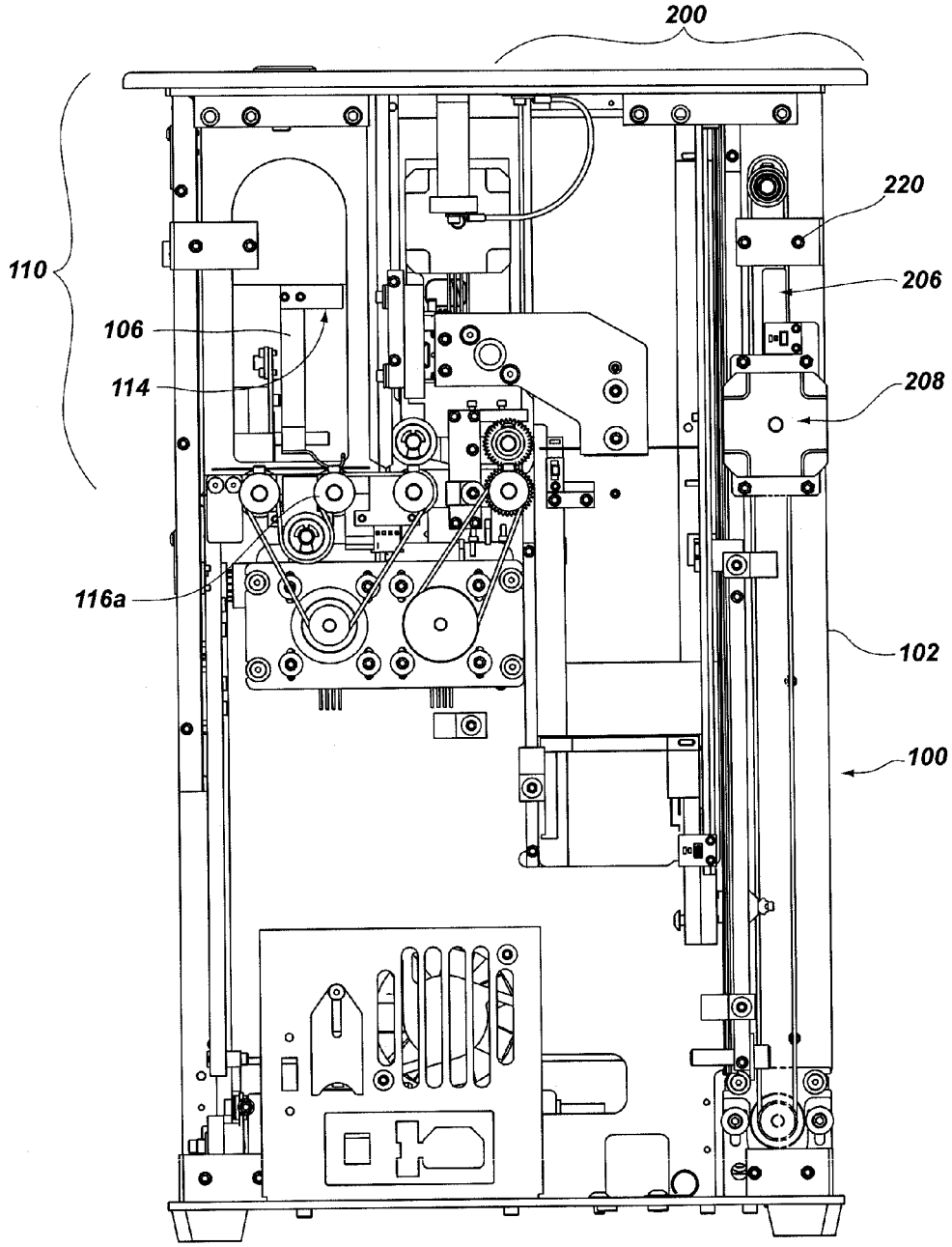
FIG. 5 shows a rear elevational view of the second exemplary card handling device of the present invention.

FIG. 5 shows a rear elevational view of the shuffler 100 with the housing removed. This view is opposite the view shown in FIG. 3. Card infeed area 110 is on the opposite side in FIG. 5. A card anti-flip aim 206 (also referred to above as a pivoting aim) is shown within the card shuffling or card collection area 200. A motor 208 for the card anti-flip arm 206 is shown, the card anti-flip arm 206 being shown in an upright (inactive) position. All reference numerals in FIG. 5 that are the same as reference numerals in FIG. 3 or FIG. 4 show similar components of the shuffler 100. In a preferred embodiment, when cards are present in grippers 220, the card anti-flip arm 206 is moved to an active position (i.e., horizontal) to prevent cards from flipping over.

In another embodiment, when the random number generator module (e.g., 118 of FIG. 3) identifies to the processor (120 in FIG. 3) that fewer than or equal to a predetermined number of playing cards are to be supported during shuffling, the playing card anti-flip aim 206 will move from an inactive to an active position. The card anti-flip arm 206 will retract to the inactive position at a predetermined time, which may be as a card is inserted below the supported card(s), after the card has been inserted below the supported card(s) or after the supported cards are combined with the cards on an elevator or before another number of playing cards is supported.

Figure 6:
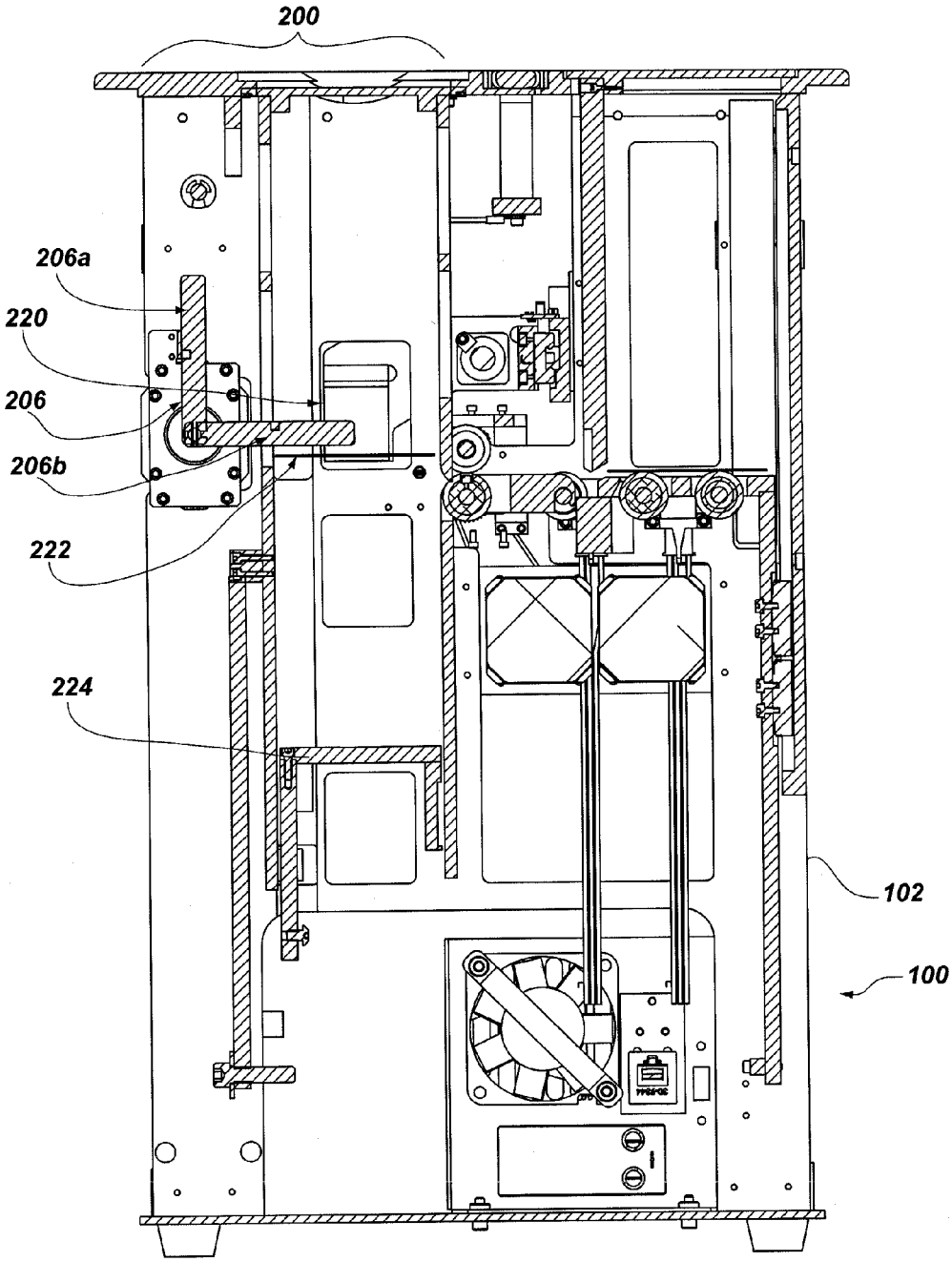
FIG. 6 shows another front elevational view of the second exemplary card handling device of the present invention with a pivotal weight arm rotated into a card-contacting position.

FIG. 6 shows a side cross-sectional view of the shuffler 100 with the housing removed, in a plane that clearly shows the operation of the card anti-flip arm 206. In the retracted or inactive position 206*a*, card anti-flip arm 206 is outside of the temporary card collection area 200, and when rotated to an engaged position 206*b*, the card anti-flip arm 206 is substantially horizontal. A small number of playing cards 222 is shown supported by one of a pair of spaced-apart grippers 220. When that number of playing cards 222 is less than or equal to a predetermined number of playing cards (e.g., 3, 4, 5, 6, 7, 8, 9, 10, etc.), the card anti-flip arm 206 is moved to position 206*b* to prevent any cards that pop out of the grippers 220 from flipping, which could cause jamming of the shuffler 100, or expose a card within the shuffled set by flipping the wrong side (face side) up in the shuffled set of cards, or causing gripped cards to become vertically aligned.

In some embodiments of the invention, when there are relatively few cards in the shuffling area 200, the playing card anti-flip arm 206 will remain in the engaged position 206*b* for some number of cards being inserted. An elevator 224 (FIG. 6) that supports and lowers playing cards (not shown) that are not gripped by the grippers 220 is also shown. After the initial number of cards are present in the shuffling area 200 and the random number generator has not selected a number of cards to be gripped less than or equal to the second predetermined number, the playing card anti-flip arm 206 will return to position 206*a*. When the random number generator selects a number of cards to be gripped less than or equal to the second predetermined number, the playing card anti-flip arm 206 will return to position 206*b* to be positioned above the playing cards 222 supported by the grippers 220.

Although specific examples, sequences and steps have been clearly described, variations and alternatives would be apparent to those skilled in the art and are intended to be within the scope of the invention claimed.

What is claimed:

1. A playing card handling device, comprising:

a card storing area that supports a stack of playing cards, the card storing area having a playing card support surface;

a card removing system that removes playing cards individually from a bottom of the stack;

a card weight comprising an arm pivotally engaged to the playing card handling device that is automatically moved by a motor between at least two positions, wherein in a first position an end of the card weight opposite a pivot is disengaged from a playing card at the top of the stack and, in a second position, the end of the card weight is engaged with a playing card at the top of the stack; and a processor in the playing card handling device that directs movement of the card weight between at least a first and second position when information is known to the processor that a predetermined number of cards is present in the card storing area of the card handling device.

2. The card handling device of claim 1, further comprising a shuffling system within the playing card handling device.

3. The card handling device of claim 2, wherein the card storing area is located within the card shuffling system.

4. The card handling device of claim 1, wherein the card storing area is a card infeed area and the card weight is located within the card infeed area.

5. The card handling device of claim 1, wherein the predetermined number of cards is between 8 and 20.

6. The card handling device of claim 1, wherein the card removing system comprises a pick-off roller and wherein the movement of the card weight into the second position applies pressure continuously against a playing card at the top of the stack and provides force between a lowest playing card in the stack and the pick-off roller during card movement.

7. The card handling device of claim 1, further comprising at least one sensor to indicate a number of cards present in the card storing area.

8. The card handling device of claim 7, wherein the processor is in communication with the at least one sensor.

9. The card handling device of claim 1, wherein the processor maintains a count of playing cards in the card storing area during operation of the playing card handling device.

10. The card handling device of claim 9, wherein the processor causes the card weight to pivot into an engaged position when a card count reaches a predetermined threshold amount.

11. The playing card handling device of claim 1, wherein the playing card handling device is a shuffling system, wherein the shuffling system comprises a playing card collection area where cards are moved individually from a playing card infeed area to the playing card collection area, and the card weight is located in the playing card infeed area, wherein the card weight moves automatically from a first card disengaged position to a second card engaged position when the card infeed area contains cards and moves from the second card engaged position to the first card disengaged position when the card infeed area is empty.

12. The card handling device of claim 11, wherein a set of grippers is provided in the playing card collection area, and further comprising a stationary card feeder and an elevator, wherein cards are elevated to an elevation of the set of grippers and the set of grippers grasp card edges, and when the elevator is lowered, at least one card is suspended and a gap is created below the suspended at least one card and a card support surface of the elevator or any cards on the elevator for insertion of a next card.

13. The card handling device of claim 12, further comprising a random number generator to randomly determine a number of cards suspended by means of the set of grippers.

14. The card handling device of claim 13, wherein the processor is configured so that when the random number generator provides a number of suspended playing cards that is equal to or less than a predetermined number, the processor directs a pivotally mounted bracing member with a pivot point and an opposite end to rotate so that the opposite end of the pivotally mounted bracing member moves into an engaged position above gripped cards.

15. The card handling device of claim 1, wherein the processor is programmed to activate the weight in response to a signal from a sensor indicating a number of playing cards in at least one storage area has reached a predetermined number.

16. The card handling device of claim 15, wherein when the processor has information that less than or equal to a predetermined number of playing cards is in the at least one storage area, the processor signals a second motor to move the card weight to an engaged position.

17. A playing card handling device, comprising:

a card infeed area that supports a stack of playing cards that has a playing card support surface;

a card removing system that removes playing cards individually from a bottom of the stack and delivers cards into a playing card collection area;

a playing card collection area where playing cards are received one at a time after being removed individually from the bottom of the stack;

a card weight comprising an arm pivotally engaged to the playing card handling device and movable between a first position where a distal end of the card weight is not in contact with any playing cards in the playing card collection area and a second position where the distal end of the card weight is in contact with a top card in the playing card collection area;

a motor to cause the card weight to pivot;

a processor to provide signals to the motor to move the card weight between the first position and the second position in response to information received from a playing card counting system; and a playing card counting system that identifies total numbers of playing cards in at least one area in the playing card collection system.

18. The playing card handling device of claim 17, wherein the playing card counting system determines a number of cards remaining in the card infeed area.

19. A playing card shuffling device, comprising:

a card infeed area that supports a stack of playing cards and that has a playing card support surface;

a card removing system that removes playing cards individually from a bottom of the stack and into a playing card collection area;

a playing card collection area where playing cards are received one at a time after being removed individually from the bottom of the stack;

a card weight comprising an arm pivotally engaged to the playing card handling device and movable between a first disengaged position where a distal end of the card weight is not in contact with any playing cards in the playing card collection area and a second engaged position where the distal end of the card weight is in contact with a top card in the playing card collection area, wherein the card weight is automatically movable by a motor;

a processor in the card handling device to provide signals to the motor to move the card weight between the first position and the second position;

a playing card counting system that identifies total numbers of playing cards in at least one area in the playing card collection area;

a pair of grippers for grasping edges of cards within the card collection area;

an elevator in the card collection area for raising and lowering cards in the card collection area; and a disengaged position and an engaged position, wherein the card weight is placed above gripped cards in the engaged position.

20. The playing card shuffling device of claim 19, wherein the processor receives a signal from a sensor that causes the card weight to pivot.

21. A method of handling playing cards, comprising:

positioning a vertically disposed stack of playing cards into a card storing area of a card handling device;

providing a card moving system that moves cards individually out of the card storing area and into a second area from a bottom of the stack;

measuring at least one parameter selected from the group consisting of: a number of cards fed from the card storing area, a number of cards remaining in the card storing area, a percent shuffle completion and a height of the stack of cards in the card storing area;

and when a predetermined value of a parameter is measured, providing a force to an uppermost card in the stack in the card storing area, thereby increasing a force between a lowest card in the stack and the card moving system.

22. The method of claim 21, wherein the second area is a card shuffling area, and further comprising the step of shuffling the cards.

23. The method of claim 22, wherein shuffling the cards comprises by suspending at least a portion of the stack in a randomly determined location, creating a gap in the stack at the randomly determined location, inserting a card, and then repeating the steps of randomly determining a location, creating a gap and inserting a card.

24. A method of handling playing cards, comprising:

positioning a plurality of stacked cards in a card handling area;

selecting a location to divide the plurality of stacked cards;

creating a gap in the plurality of stacked cards at the selected location by suspending all cards above the selected location in the plurality of stacked cards; and applying a bracing member above a top card in the suspended stacked cards to prevent cards from moving out of suspension.

25. The method of claim 24, further comprising the step of providing a stack of cards in a card storing area, and moving cards individually into the card handling area.

26. The method of claim 25, wherein the cards are fed individually from a bottom of a vertically positioned stack in the card storing area.

27. The method of claim 25, wherein an elevator with an upper surface is provided in the card handling area, and cards are elevated in the card handling area.

28. The method of claim 24, wherein the location to divide the plurality of stacked cards is randomly selected.

29. The method of claim 24, wherein the gap is created in the plurality of stacked cards by elevating cards to a preselected elevation, grasping a number of cards above the selected location and lowering the cards that were not grasped to create an opening for insertion of a next card.

30. The method of claim 24, and further comprising the step of moving the bracing member to a disengaged position.

* * * * *